US005417448A

United States Patent [19]

Le Masson et al.

[11] Patent Number: 5,417,448

[45] Date of Patent: May 23, 1995

[54] SHOCK ABSORPTION DEVICE FOR A SKI

[75] Inventors: Jacques Le Masson, Cran Gevrier; Alex Phelipon, Annecy, both of France

[73] Assignee: Salomon S.A., Annecy Cedex, France

[21] Appl. No.: 162,699

[22] Filed: Dec. 7, 1993

Related U.S. Application Data

[63] Continuation of Ser. No. 900,296, Jun. 18, 1992, Pat. No. 5,332,252.

[30] Foreign Application Priority Data

Jul. 4, 1991 [FR] France ..... 91 08633

[51] Int. Cl.[6] ..... A63C 5/075

[52] U.S. Cl. ..... 280/602; 280/607

[58] Field of Search ..... 280/11.14, 602, 607, 280/609, 610, 617, 633, 636

[56] References Cited

U.S. PATENT DOCUMENTS

| | | | |
|---|---|---|---|
| 2,258,046 | 10/1941 | Clement | 280/11.13 |
| 2,539,224 | 1/1951 | Berli | 280/602 |
| 2,661,219 | 12/1953 | Coulson, Jr. | 280/602 |
| 3,260,531 | 7/1966 | Heuvel | 280/602 |
| 3,260,532 | 7/1966 | Heuvel | 280/602 |
| 3,398,968 | 8/1968 | Mutzhas | 280/11.13 |
| 3,937,481 | 2/1976 | Koleda | 280/11.35 |
| 4,139,214 | 2/1979 | Meyer | 280/602 |
| 4,537,417 | 8/1985 | Hirnbock et al. | 280/602 |
| 4,561,673 | 12/1985 | Pascal et al. | 280/629 |
| 4,577,886 | 3/1986 | Chernega | 280/602 |
| 4,592,567 | 6/1986 | Sartor | 280/602 |
| 4,740,009 | 4/1988 | Hoelzl | 280/602 |
| 4,804,200 | 2/1989 | Kuchler | 280/602 |
| 4,865,345 | 9/1989 | Piegay | 280/602 |
| 4,896,895 | 1/1990 | Bettosini | 280/607 |
| 4,903,979 | 2/1990 | Dimier | 280/628 |
| 4,974,867 | 12/1990 | Rullier et al. | 280/607 |
| 5,242,188 | 9/1993 | Bigler et al. | 280/607 X |
| 5,251,923 | 10/1993 | Stepanek et al. | 280/602 |
| 5,269,555 | 12/1993 | Ruffinengo | 280/602 |
| 5,280,942 | 1/1994 | Ruffinengo | 280/602 |
| 5,284,357 | 2/1994 | Tinkler | 280/602 |
| 5,332,252 | 7/1994 | LeMasson et al. | 280/602 |

FOREIGN PATENT DOCUMENTS

| | | | |
|---|---|---|---|
| 327754 | 2/1976 | Australia . | |
| 373786 | 2/1984 | Australia . | |
| 376571 | 12/1984 | Australia . | |
| 376890 | 1/1985 | Australia . | |
| 0104185 | 3/1983 | European Pat. Off. . | |
| 0409749 | 7/1990 | European Pat. Off. . | |
| 0460574 | 12/1991 | European Pat. Off. . | |
| 0492658 | 7/1992 | European Pat. Off. . | |
| 0564767 | 10/1993 | European Pat. Off. . | |
| 1115843 | 4/1956 | France . | |
| 1118857 | 6/1956 | France . | |
| 1269049 | 6/1961 | France . | |
| 1407710 | 6/1965 | France . | |
| 1433242 | 2/1966 | France . | |
| 1467141 | 1/1967 | France . | |
| 2433350 | 3/1980 | France . | |
| 2503569 | 10/1982 | France . | |
| 2537442 | 6/1984 | France . | |
| 2575393 | 7/1986 | France . | |
| 2654636 | 5/1991 | France . | |
| 2675392 | 10/1992 | France . | |
| 1603002 | 8/0019 | Germany . | |
| 1578852 | 3/1971 | Germany . | |
| 2135450 | 4/1972 | Germany . | |
| 2259375 | 6/1974 | Germany . | |
| 3315638 | 12/1983 | Germany | 280/602 |
| 3505255 | 8/1986 | Germany | 280/602 |
| 3933717 | 4/1990 | Germany | 280/602 |
| 4020212 | 1/1991 | Germany | 280/602 |
| 73456 | 4/1948 | Norway | 280/602 |
| WO83/03360 | 10/1983 | WIPO | 280/602 |
| WO88/01189 | 2/1988 | WIPO . | |
| WO88/05324 | 8/1988 | WIPO . | |

*Primary Examiner*—Brian L. Johnson

*Attorney, Agent, or Firm*—Sandler, Greenblum & Bernstein

[57] ABSTRACT

Shock absorption device adapted to damp the vibrations of a ski, comprising at least one flexion blade that includes a first portion fixed to the ski and a second portion connected to the ski in a longitudinally mobile manner by a friction device.

37 Claims, 9 Drawing Sheets

1
2
3
4
6
8
13
14
100
130
140
141
142
d

Fig- 15
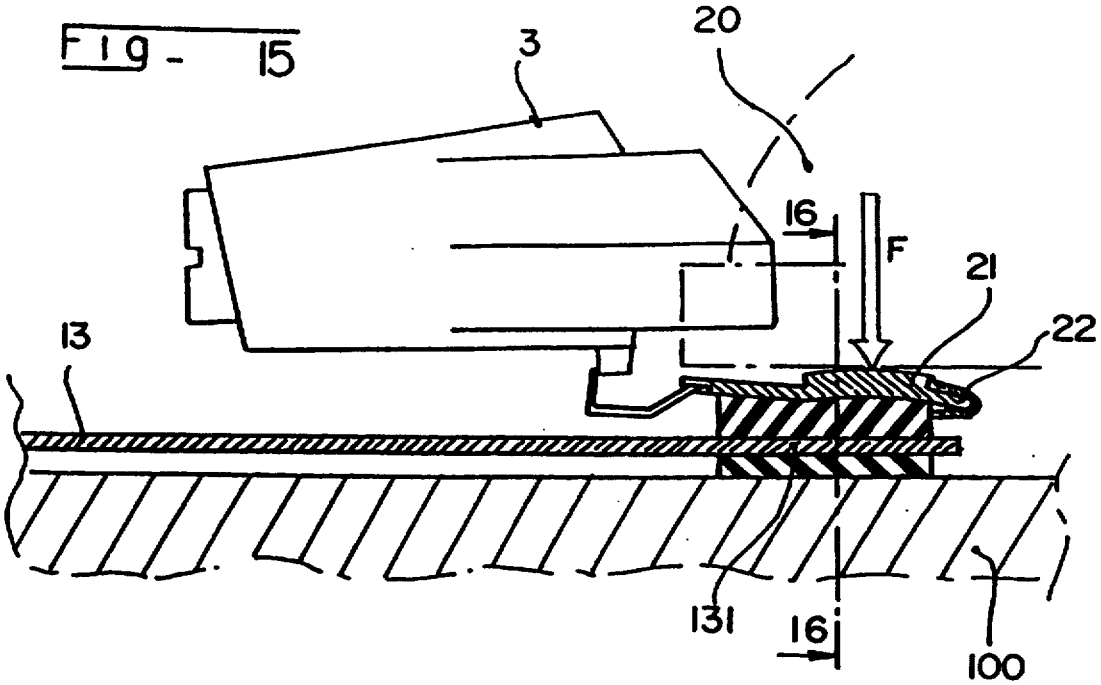
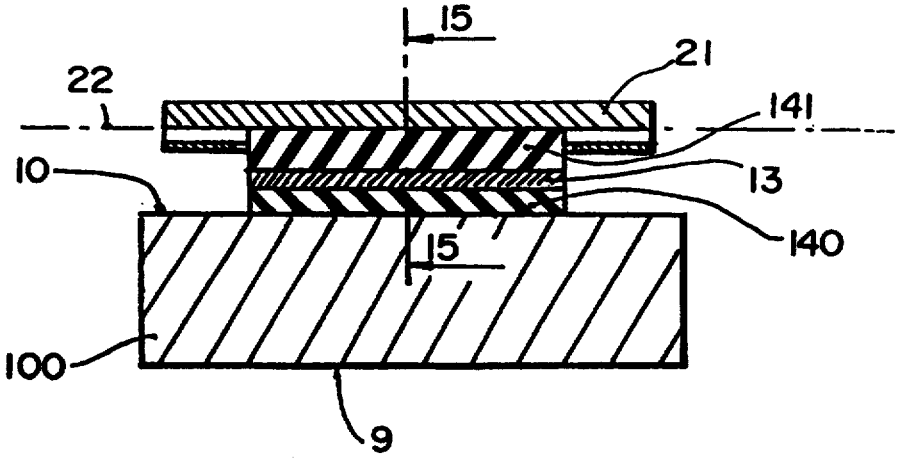
Fig- 16

SHOCK ABSORPTION DEVICE FOR A SKI

This application is a continuation of application Ser. No. 07/900,296, filed on Jun. 18, 1992, now U.S. Pat. No. 5,332,252, issued on Jul. 26, 1994.

BACKGROUND OF THE INVENTION

1. Field of the Invention

The present invention is related to a shock absorption device for a ski, such as an alpine ski, a cross-country ski, a mono-ski or a snowboard. It is particularly related to an improvement of this type of device, and is also related to a ski equipped with such a device.

2. Background and Material Information

Skis that are relatively flexible are known.

Further, various types of skis and numerous variations thereof are also known. For example, skis are known to be comprised of a beam of an elongated shape whose front end is curved upwardly to constitute a spatula, the rear end also being curved, but to a lesser degree, to constitute the heel.

Currently known skis generally have a composite structure in which different materials are combined in such a way that each of them cooperates optimally, taking into account the distribution of mechanical stresses during use of the ski. Thus, the structure generally comprises peripheral protection elements, internal resistance elements to resist flexion and torque stresses, and a core. These elements are assembled by adhesion or by injection, the assembly generally being done in a hot mold having the definitive shape of the ski, with a front portion raised substantially in a spatula, a rear portion slightly raised in a heel, and a central arched portion.

Despite manufacturers' concerns for constructing high-quality skis, until now they have not yet found a high-performance ski that is satisfactory in all conditions of use.

Current skis have a certain number of disadvantages, and particularly, they perform unsatisfactorily during oscillation due to the vibrations or the flexions of the ski. Indeed, persistent vibrations result in a loss of adherence and thus lead to bad performance from the ski. Thus, it is extremely important to damp the vibrations, and to this end, various solutions have already been suggested. Notably, for example, the solutions proposed in the French Patent Publication Nos. 2,503,569 and 2,575,393. But these shock absorption devices only have very negligible effects that are imperceptible to the skier.

SUMMARY OF THE INVENTION

An object of the present invention is to overcome the various disadvantages described hereinabove, and a solution is proposed that is particularly simple, efficient and reliable with respect to problems related to damping vibrations.

To this end, the shock absorption device according to the invention and adapted to damp the vibrations of the ski, includes at least one flexion blade or similar element, that comprises a first portion fixed rigidly to the ski, and a second portion connected to the ski in a longitudinally mobile manner, by a friction or rubbing means.

According to a complementary characteristic, the second portion is spaced longitudinally from the first portion, in order to amplify the relative longitudinal displacements of the second portion of the blade with respect to the ski.

According to an advantageous arrangement, the friction means comprise at least one friction layer and a pressure element, so that the dissipation of energy by friction is rendered efficient. The friction layer may be adhered on the flexion blade, or adhered on the ski, or even adhered on the pressure element.

According to one embodiment, the pressure element is a fixed element affixed to the ski.

According to other embodiments, the pressure element is constituted by the base-plate of the binding adapted to retain the ski boot, or a movable element on which the ski boot rests.

The flexion blade is a metallic blade, made of aluminum or steel, or of a composite material. It has a rectangular transverse section, and can be constituted by a rod having a circular section.

The invention is also related to the ski equipped with the device according to the invention, which can either be outside its structure or inside such structure.

BRIEF DESCRIPTION OF THE DRAWINGS

Other characteristics and advantages of the invention will become apparent from the description that follows with respect to the annexed drawings, provided only as non-limiting examples.

FIG. 1 is a side elevation view;

FIG. 2 is a top view;

FIG. 3 is a transverse section along line 3—3 of FIG. 2, on a larger scale;

FIG. 4 is a longitudinal section along line 4—4 of FIG. 2, on a larger scale;

FIGS. 5 and 6 show, in a side elevation view, how the device operates, FIGS. 5*a* and 6*a* being partial representations at a larger scale of FIGS. 5 and 6;

FIGS. 12 and 13 show a variation of the embodiment, FIG. 12 being a side elevation view, whereas FIG. 13 is a transverse section along line 13—13 of FIG. 12;

FIGS. 15 and 16 show a detailed view of another variation of the friction means, FIG. 15 being a partial side elevation view and a partial longitudinal section along line 15—15 of FIG. 16, whereas FIG. 16 is a transverse section along line 16—16 of FIG. 15;

FIGS. 18 to 20 illustrate a variation of the embodiment, FIG. 18 being a side elevation view, whereas FIG. 19 is a transverse section along both of lines 19—19 of FIG. 18, and whereas FIG. 20, a transverse section along 20—20 of FIG. 18, FIG. 19 also being a section along both lines 19—19 of FIG. 22;

FIG. 22 is a side elevation view;

FIG. 23 is a sectional view along both of lines 23—23 of FIG. 22; and

DETAILED DESCRIPTION OF THE PREFERRED EMBODIMENTS

Figure 1:
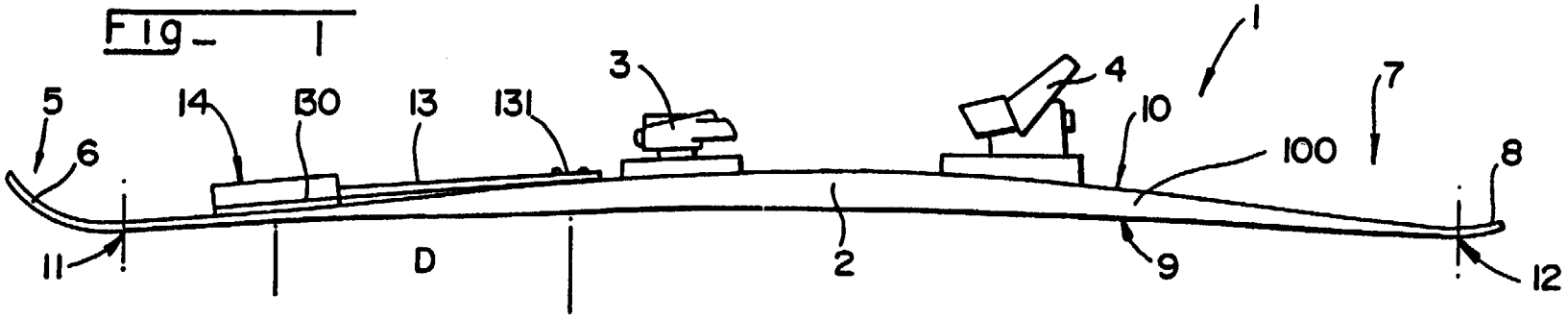
FIGS. 1 to 6 represent a first embodiment.
Figure 2:
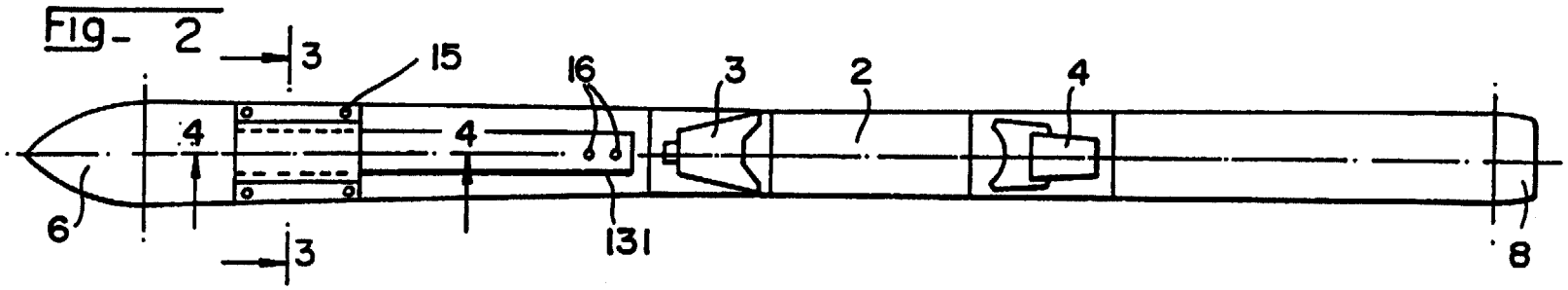

Ski 1, comprising an embodiment of the invention, includes an elongated beam 100 having its own distribution of thickness, of width and thus its own stiffness. It comprises a central portion 2, also referred to as the assembly zone of the bindings 3, 4 adapted to retain the boot on the ski, the front binding 3 being commonly called an abutment, whereas the rear binding 4 is generally called a heel attachment.

The front end 5 of ski 1 is raised to form the spatula 6, whereas the rear end 7 is also raised to form the heel 8 of the ski. The beam also comprises an inner sliding surface 9 and an upper surface 10. It must be noted that the contact of the lower surface 9 with the snow occurs between the front contact line 11 and the rear contact line 12 corresponding to the areas where the lower surface begins to rise from a planar surface.

FIGS. 1 to 6 represent a first embodiment according to which the shock absorption device according to the invention includes a flexion strip or blade 13 arranged at the front of the upper surface 10 of ski 1. According to the invention, the flexion blade is fixed to the ski by a first portion constituted by the rear end 131 of the blade, whereas the blade is connected to it by a second portion, by a friction device or means 14, thereby providing a dampening connection device. The binding of the first portion 131 of the blade on the ski is a rigid connection, obtained for example by screws, by adhesion, or by welding, to affix end 131 against longitudinal movement relative to the ski.

According to this embodiment, the second portion is constituted by the front end 130 of flexion blade 13 which is longitudinally mobile with respect to the ski, and is connected to it by friction means 14, that are constituted by two layers 140, 141 of a material having a dry, high friction coefficient and a retention and Support stirrup 142. The dry, high friction material can be constituted, for example, by a layer of thermoplastic rubber or by a viscoelastic material. Thus, a first rubber layer 140 is adhered on the upper surface 10 of the ski, whereas a second layer 141 is adhered beneath the central wall 143 of the retention stirrup that has the shape of an Ω (omega) and which is affixed to the ski by screws 15. The front end 130 of the flexion blade can thus be displaced along the directions indicated by arrows F1 and F2 between the first layer and the second layer of rubber.

In order to have energy dissipation of the longitudinal movements in the direction of arrows F1 and F2 of end 130 of the blade, the stirrup maintains a pressure and pinches the blade between the two layers. To this end, the height h of the lower housing 144 of the stirrup is slightly smaller than the sum of the thicknesses of the blade and of the two layers when such layers are in a resting position, not pinched by the stirrup.

Naturally, the tightening force or intensity of the flexion blade between the two friction layers can be adjustable in accordance with the shock absorption that one wishes to obtain.

Figure 3:
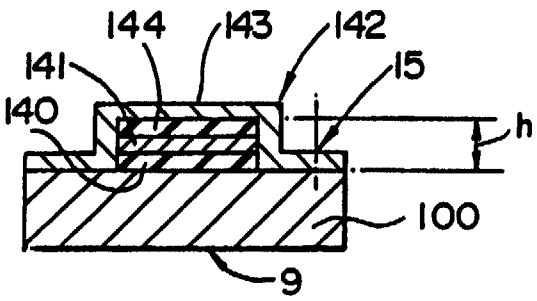
Figure 7:
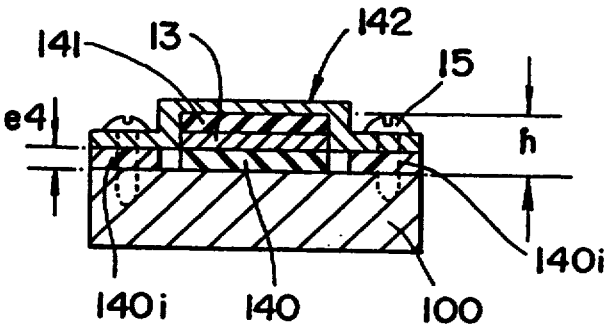
FIG. 7 is a view similar to FIG. 3, showing a variation.

FIG. 7 is a view similar to FIG. 3, representing an embodiment of the adjustment means of the tightening force, and thus, of the friction intensity. According to this variation, stirrup 142 is not in support on the upper surface 10 of ski 100, but is in support on an intermediate elastic layer 140*i*. Thus, the tightening value of screws 15 defines the tightening force of blade 13 between the two layers 140, 141, by varying thickness *e*4.

Figures 5, 5A, 6, 6A:
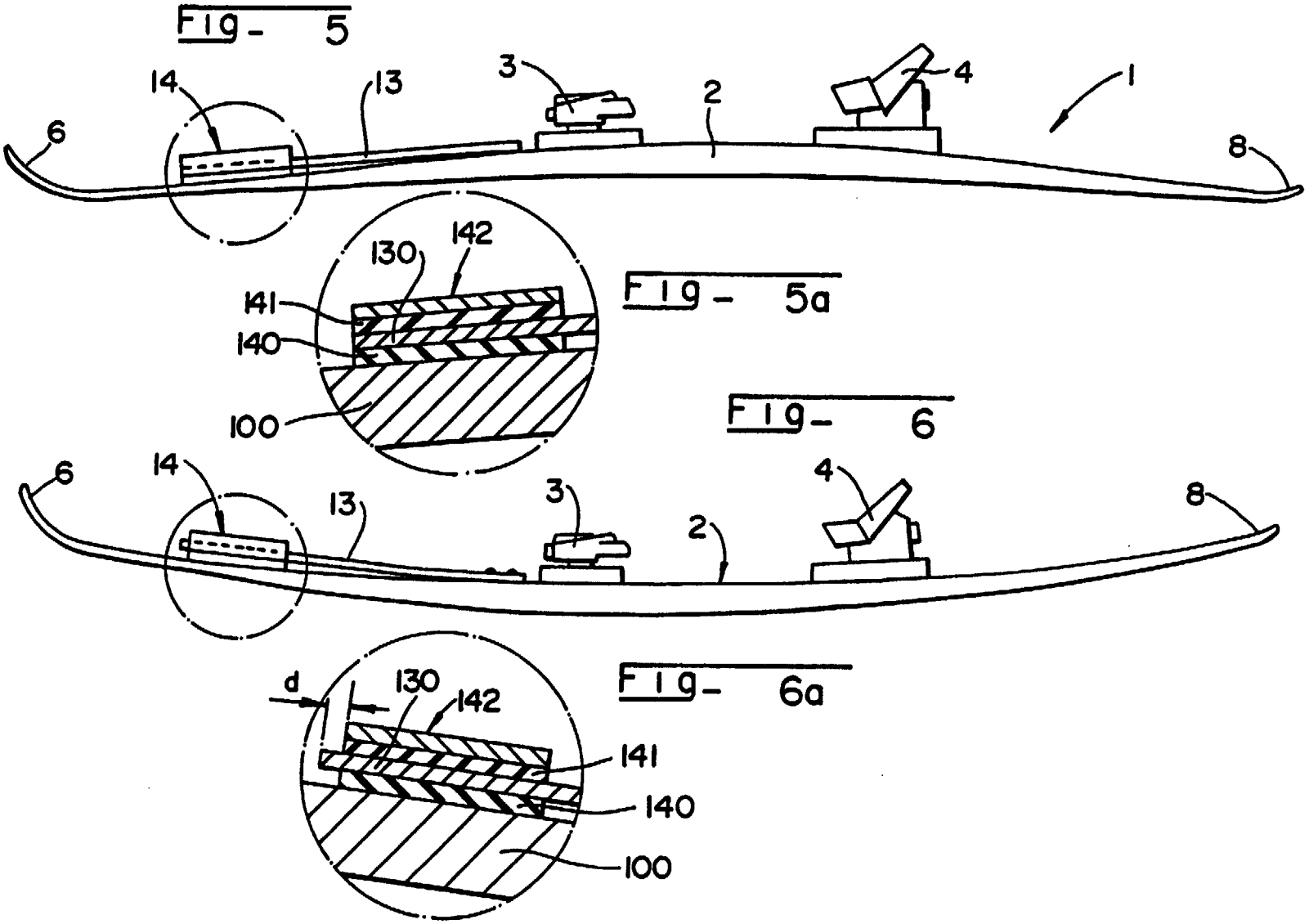

FIGS. 5, 5A, 6 and 6A schematically represent the functioning of the shock absorption. FIG. 5 shows the ski in the resting position, and FIG. 6, during flexion. During flexion, there is a relative frontward displacement of front end 130 of the blade with respect to the friction means 14. According to the schematic representation, the front end is displaced frontwardly along direction F1 by a distance d and such displacement has been braked by the friction layers 140, 141.

Figure 8A:
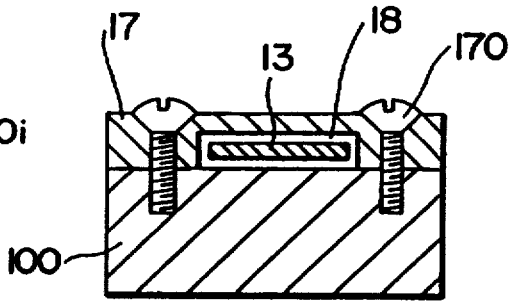
FIG. 8 and 8*a* represent a variation, FIG. 8*a* being a transverse section along line 8*a*—8*a* of FIG. 8.
Figure 8:
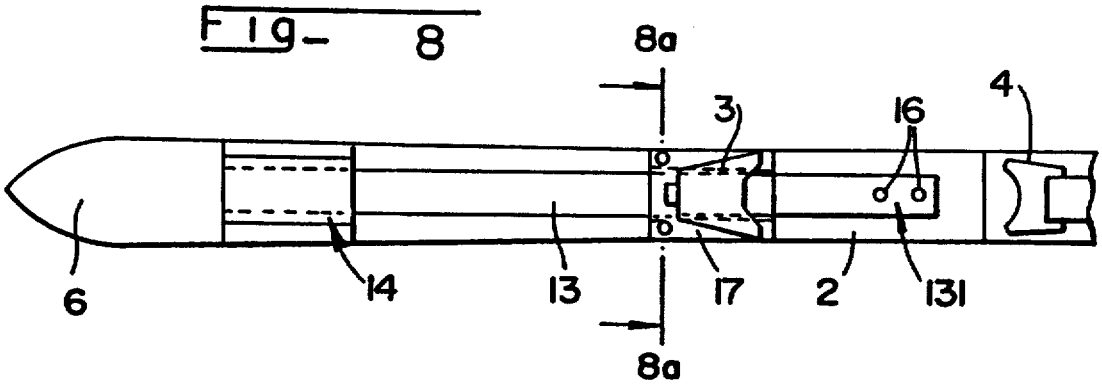

It is understood that the flexion blade can be more or less long, and for example, be as represented in FIG. 8. According to this variation, blade 13 passes freely beneath base plate 17 of abutment 3 which comprises a lower housing 18 whose dimensions are greater than the dimensions of the blade, to enable its passage and free movement. The blade thus being fixed by its rear end 131 in central zone 2 is positioned between front binding 3 and rear binding 4.

Figure 9:
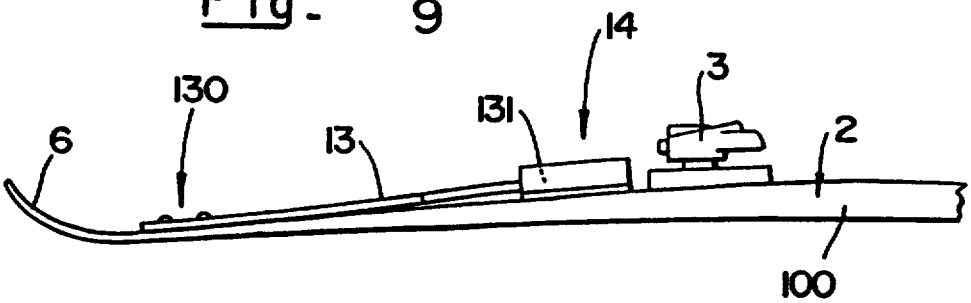
FIG. 9 is a partial side elevation view showing another variation of the embodiment.

FIG. 9 represents another embodiment according to which the front end 130 of the blade is fixed rigidly on the ski, whereas the rear end 131 is slidably mounted in the friction means 14.

Figure 10:
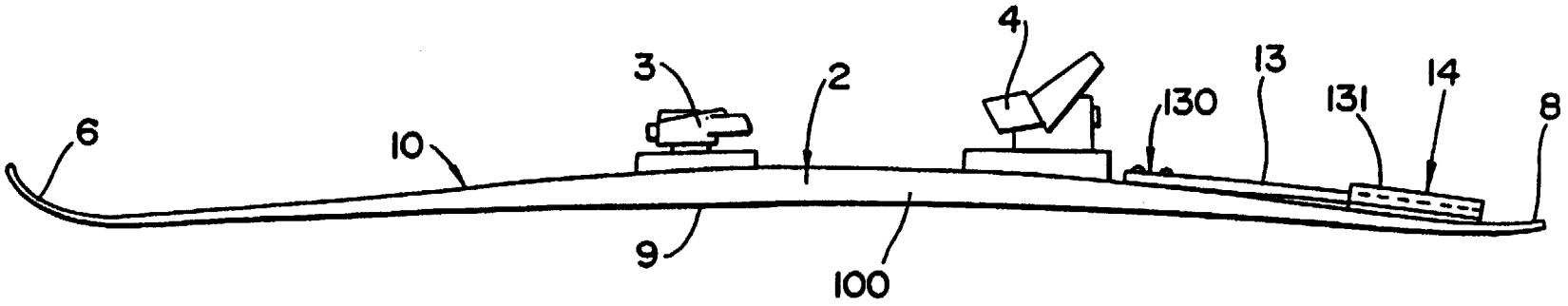
FIGS. 10 and 11 are views similar to FIGS. 1 and 2 showing another embodiment.
Figure 11:
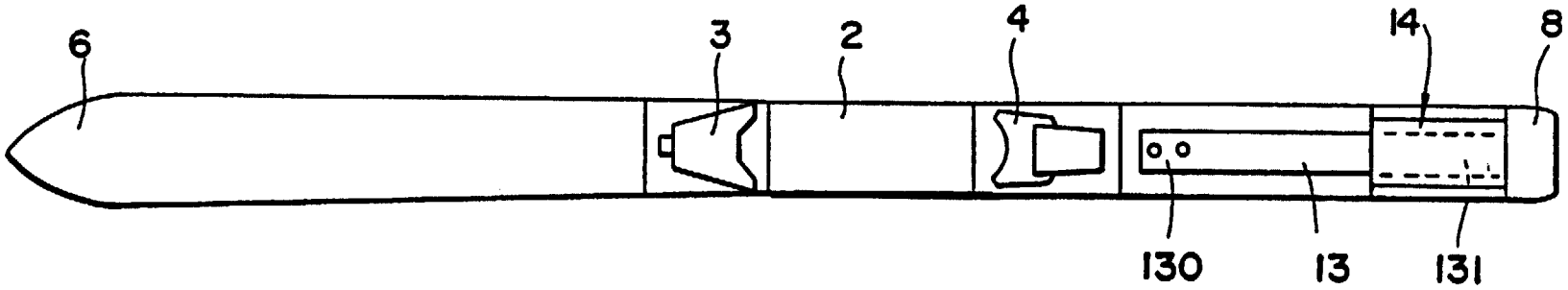

The shock absorption device according to the invention, such as described previously, can be located at the rear of the ski, as is shown in FIGS. 10 and 11. Thus, the front end 130 of blade 13 is fixed to the ski and extends rearwardly in such a way that its rear end 131 is connected to the ski in a longitudinally movable manner by friction means 14.

Figure 12:
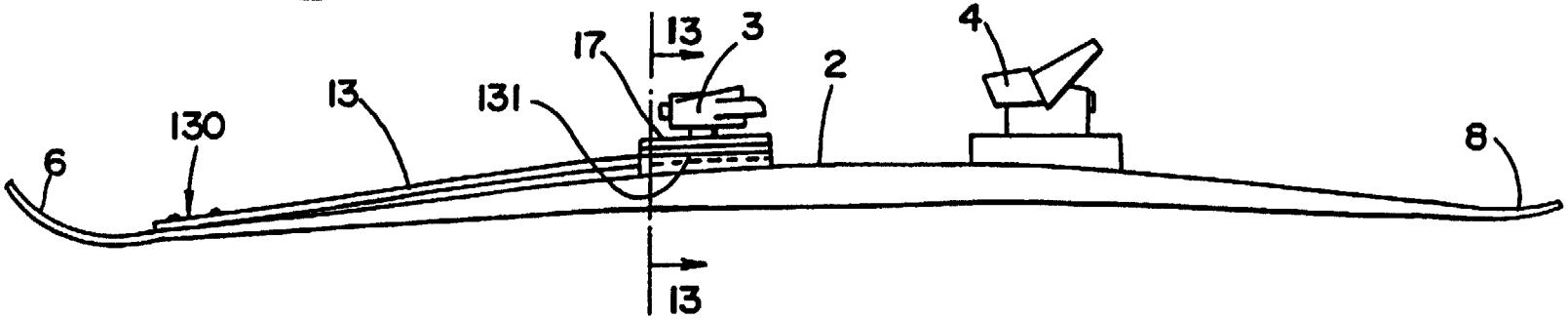
Figure 13:
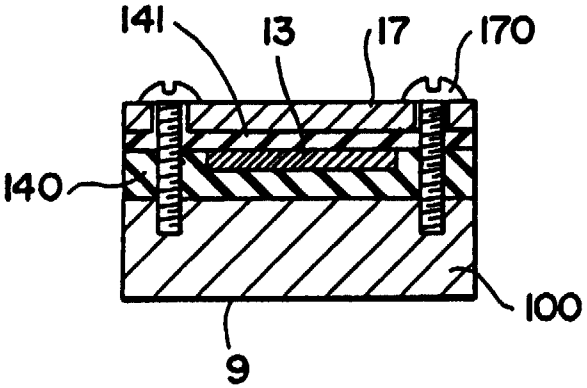

The friction means comprise pressuring means required for friction. These means can be constituted by a pressure element such as the stirrup described previously and represented in FIGS. 1–11, but may also be constituted by any other suitable device or element. Thus, the friction means can be located beneath one of the bindings, the assembly of such means on the ski ensuring the required pressure, and thus constituting the pressure elements. FIGS. 12–13 represent such an arrangement.

According to this variation, the flexion blade is fixed to the ski by its front end 130, whereas its rear end 131 is retained by friction means located beneath the front binding 3 by an assembly that can be seen in greater detail in FIG. 13. As in the previous embodiments, flexion plate 13 is pinched between two layers of friction material 140, 141. Thus, the lower layer 140 adhered on the ski is formed by an element having a U-shaped profile, whereas the upper layer 141 is adhered beneath base plate 17 of abutment 3. It is the more or less substantial tightening of screws 170 that will ensure a more or less substantial friction.

Figure 14:
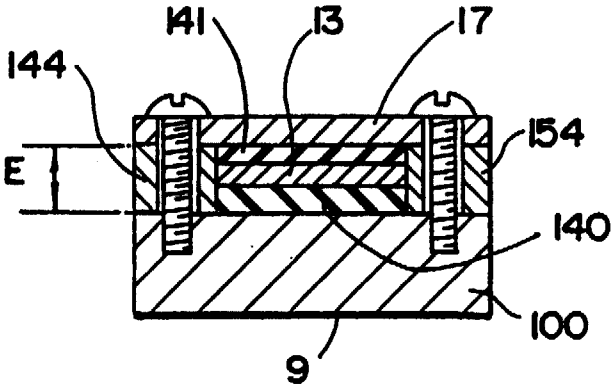
FIG. 14 is a view similar to FIG. 13, showing another embodiment of FIG. 13.

FIG. 14 is a view similar to FIG. 13 showing a variation according to which the tightening is no longer dependent on the screwing intensity of screws 170, but only on the thickness dimensions of the various elements. Thus, lateral spacers 154 made of a rigid material are provided, ensuring a rigid support of the base plate and a definite thickness E.

The friction pressure can be variable and, for example, be a function of the support force of ski boot 20. According to this new embodiment represented in FIGS. 15 and 16, abutment 3 comprises a support element 21 for the boot 20 which is mounted movably about a transverse axis 22, beneath which one of the friction layers 141 is adhered, whereas the other layer 140 is adhered on the upper surface 10 of the ski. The rear end 131 of blade 13 can thus be displaced longitudinally between the two friction layers 140, 141. This displacement being more or less braked in accordance with the value of force F applied by the boot on the support plate 21. It must be noted that binding 3 with its movable support plate 21 was the object of French Patent Publication No. 25.37442 filed by the Applicant.

Figure 17:
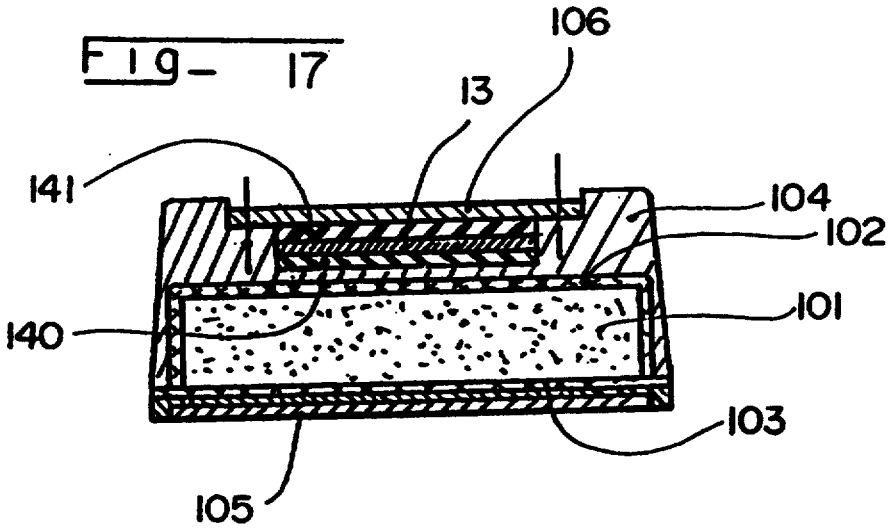
FIG. 17 is a transverse sectional view of the ski whose shock absorption device is embedded.

In the various embodiments suggested in FIGS. 1–16, the shock absorption device is located outside the actual structure of the ski. But it would not be outside the scope of the invention if such device were located within the structure of the ski itself, as is represented schematically in FIG. 17.

Skis are most often constituted by a core 101 covered by one or several upper reinforcement layers 102, and possibly even lower reinforcement layers 103. The top of the ski being generally covered by a decorative layer 104, whereas the bottom comprises a sliding layer made of polyethylene 105. Thus, in the embodiment of FIG. 17, the shock absorption device is embedded in the ski and an upper plate 106 simultaneously ensures the pressure or support required for friction, as well as the impermeability of the device by insulating it totally from the outside.

In the solution suggested previously, the friction layers are adhered on the ski and on the friction element. However, it can also be otherwise, and the friction interfaces 140, 141 can be linked to the blade so as to rub on the ski and/or on pressure or support element 142, 17, 21. Moreover, the friction layers 140, 141 which only extend along the end of the blade, in the embodiments represented, can also extend along a greater length, perhaps even along the entire length of the blade.

Figure 18:
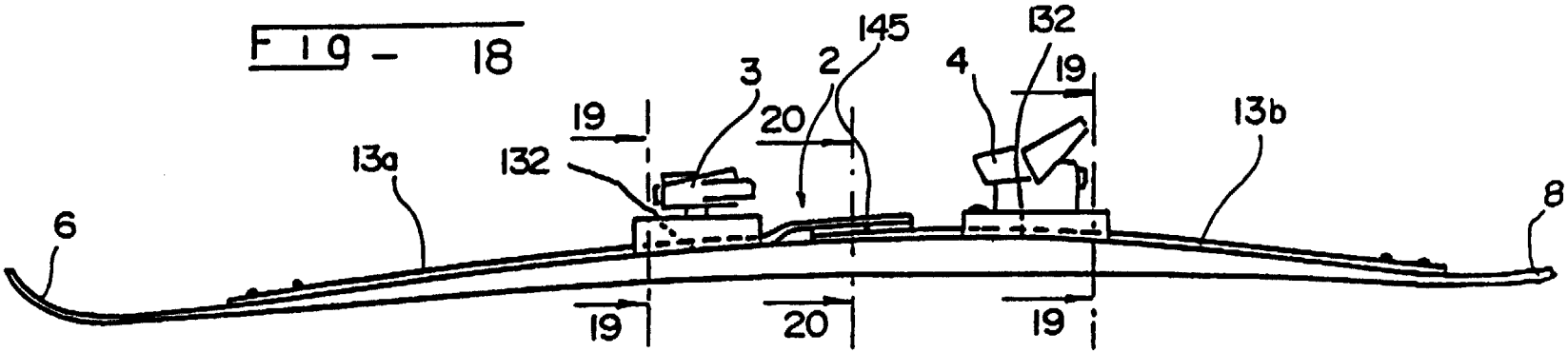
Figure 20:
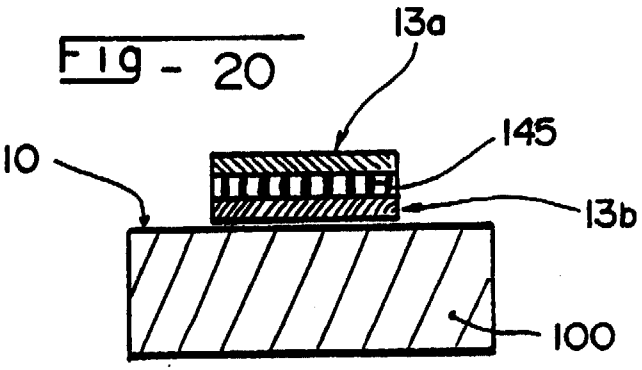
Figure 19:
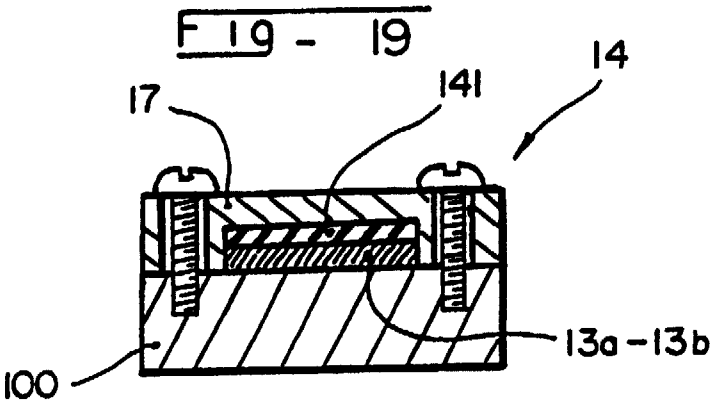

Shock absorption by friction can be combined with shock absorption by shearing, as has been described in French Patent Publication No. 26.75392. FIGS. 18–20 represent such a variation according to which the ski comprises a first front blade **13*a* and a second rear blade 13*b*. The front blade 13*a* is fixed to the ski by its front end, whereas the rear blade 13*b* is fixed by its rear end. The two blades extend towards the central zone 2 to overlap mutually and to be connected together by a layer 145 made of a viscoelastic material. Shock absorption by friction, of course, is also obtained as represented in the embodiments of FIGS. 12, 13 and 14 or analogous figures. FIG. 19 shows such an embodiment according to which the flexion blades 13*a*, 13*b* are tightened in their median portion 132 between a layer of friction material 141 and the upper surface of the ski, respectively, by virtue of the pressure supplied by the base plate of abutment 3 and of heel attachment 4**.

Figure 21:
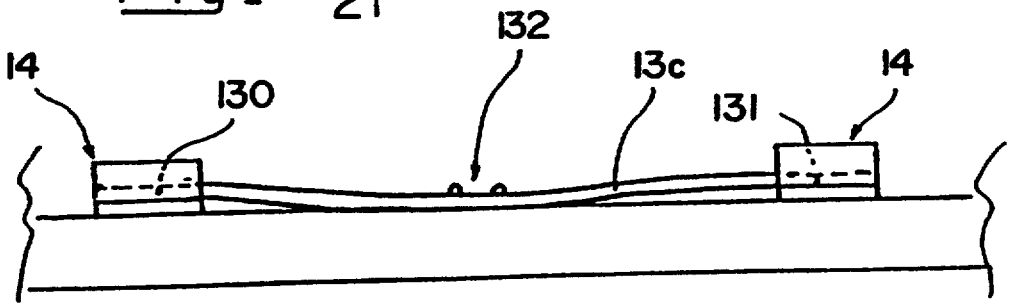
FIG. 21 is a lateral schematic view of another variation.

FIG. 21 represents another variation in a lateral view according to which the shock absorption device is constituted friction means 14.

The flexion blade **13, 13*a*, 13*b*, 13*c*** is a blade made of steel, aluminum or of a composite material whose width l is comprised between 10 and 60 mm, its thickness $e_1$ comprised between 1 and 5 mm, and its length $L_1$ comprised between 200 and 1200 mm.

Figure 22:
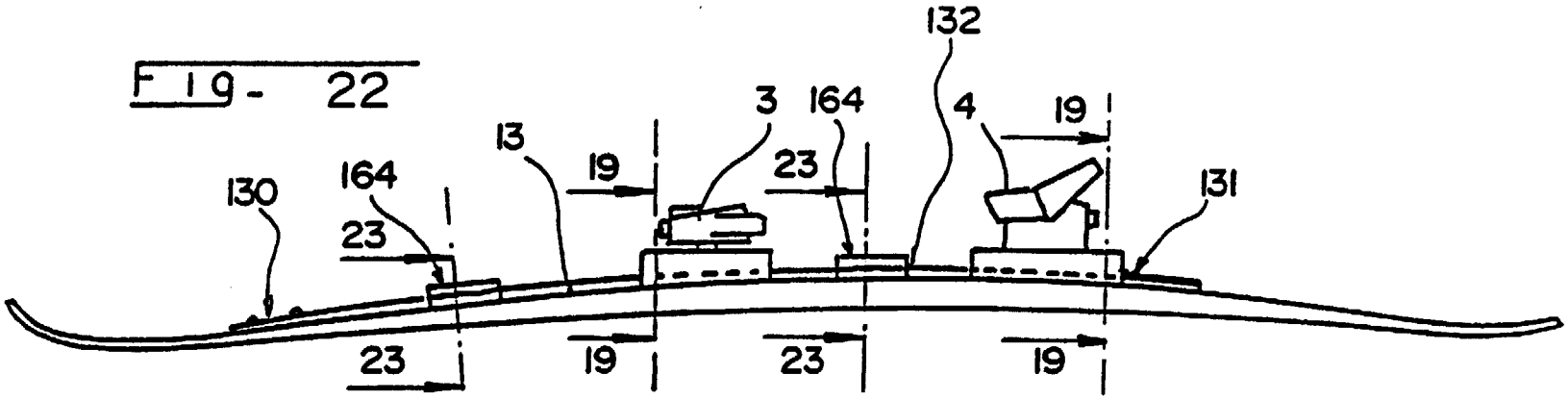
FIGS. 22 and 23 represent another embodiment.
Figure 23A:
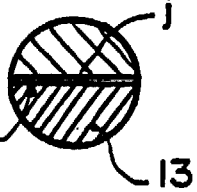
Figure 23:
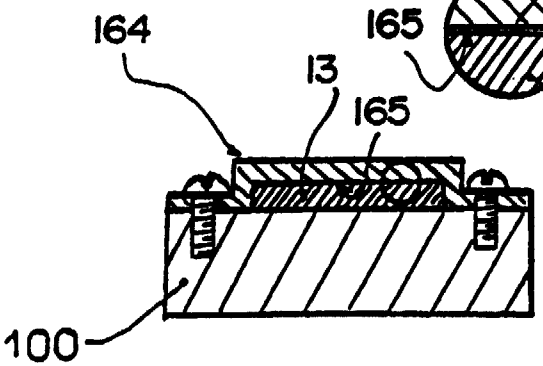

FIGS. 22 and 23 represent another embodiment according to which the flexion blade 13 is fixed to the ski by its front end 130, whereas it is retained on the ski by its median portion 132 and its rear portion 131, by friction means, such as described for the embodiments of FIGS. 18 and 19. Thus, FIG. 19 is also a sectional view along both of lines 19—19 of FIG. 22. Moreover, to avoid buckling of the flexion blade, the device comprises means to stop buckling that are constituted by retention stirrups 164 fixed to the ski and comprising a lower housing 165 enabling passage of the blade, and its longitudinal displacement, but retaining it vertically to stop it from being displaced upwardly. Thus, between the lower housing and the blade, a small functional clearance j has been provided.

Figure 4:
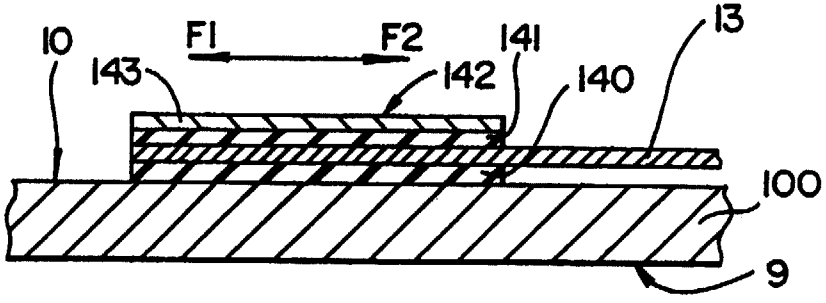
Figure 24:
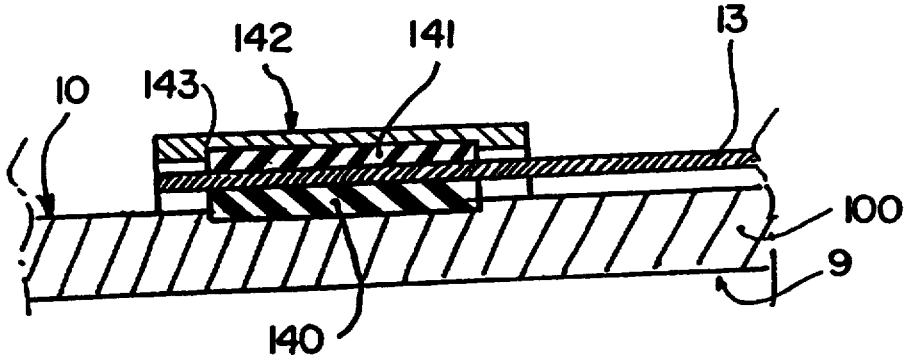
FIGS. 24 and 25 are views similar to FIG. 4 showing variations of the embodiment.

To avoid any longitudinal displacement of the friction layers 140, 141, such layers can be embedded at least partially in their respective support element, as has been represented in FIG. 24, which is a view similar to FIG. 4.

Figure 25:
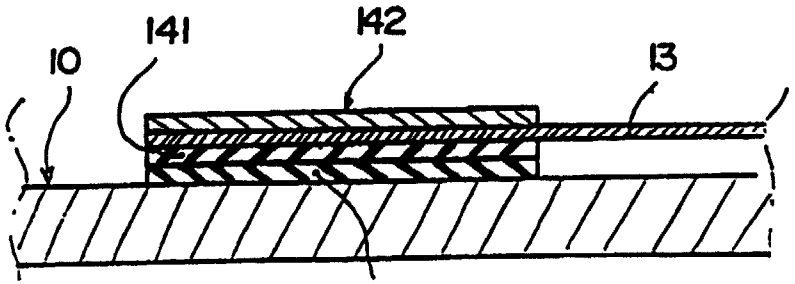

FIG. 25 is another view similar to FIG. 4, showing another embodiment according to which the lower friction layer 140 is adhered on the ski, whereas the upper layer 141 is adhered beneath the blade 13 and is supported on said lower friction layer.

It is understood that the flexion blade which, in the embodiments illustrated, has a rectangular section, can have any other type of shape. It can, for example, be constituted by a cylindrical rod.

Moreover, it must be noted that the material constituting the friction layers are chosen in accordance with the type of shock absorption to be obtained, and for example, in accordance with the type of ski, or type of use.

Naturally, the shock absorption device may not comprise a friction layer. Indeed, the flexion blade can also rub directly on the ski whose surface could be more or less rough, granulated, or striated.

The shock absorption device can be covered with an external envelope acting both as an impermeable element and as a decorative element. This external envelope can also act as a stirrup or a retention element stopping buckling of the blade.

Further, the invention is not limited to the embodiments described and represented as examples hereinabove, but it also comprises all technical equivalents as well as combinations thereof.

What is claimed is:

1. A device for dampening vibration of a ski, comprising:

at least one longitudinally extending flexible blade having a first portion and a second portion;

at least one fixed connection device for affixing the first portion to the flexible blade against longitudinal movement with respect to the ski; and at least one dampening connection device to be affixed to the ski for allowing the second portion of said flexible blade to move longitudinally with respect to the ski upon ski flexion, said at least one dampening connection device comprising a frictional connection, whereby said second portion of said flexible blade comprises a surface in a longitudinal frictional sliding relationship, with respect to a surface of said dampening connection device affixed with respect to the ski, during use of the ski, at least one of said surfaces comprising a surface of a friction layer having a high coefficient of friction;

said frictional connection further comprises a pressure element, said pressure element being adapted to be affixed to the ski for applying a force to maintain a frictional force between a surface of said flexible blade and a surface of said dampening connection device.

2. A device according to claim 1, wherein:
said frictional connection comprises at least one surface fixed with respect to said second portion of said flexible blade in longitudinal frictional sliding contact with a further surface fixed with respect to the ski.
3. A device according to claim 1, wherein:
said further surface is a surface of the ski itself.
4. A device according to claim 1, wherein:
said one surface is a surface of the flexible blade.
5. A device according to claim 1, wherein:
said first portion of said flexible blade is longitudinally spaced from said second portion at a predetermined distance.
6. A device according to claim 1, wherein:
said friction layer is affixed to said second portion of said flexible blade.
7. A device according to claim 1, wherein:
said friction layer is affixed to the ski.
8. A device according to claim 1, wherein:
said friction layer is affixed to said pressure element.
9. A device according to claim 1, wherein:
said pressure element comprises a stirrup affixed to the ski.
10. A device according to claim 1, further comprising:
a base plate of a ski binding that affixes a ski boot upon a ski, wherein said base plate comprises said pressure element.
11. A device according to claim 1, further comprising:
a support element for supporting a ski boot and means for mounting said support element for movement under the weight of the ski boot, wherein said support element comprises said pressure element.
12. A device according to claim 1, wherein:
said friction layer comprises a layer of elastic material.
13. A device according to claim 1, wherein:
said friction layer comprises a layer of viscoelastic material.
14. A device according to claim 1, wherein:
said flexible blade is made of aluminum.
15. A device according to claim 1, wherein:
said flexible blade is made of steel.
16. A device according to claim 1, wherein:
said flexible blade is made of a composite material.
17. A device according to claim 1, wherein:
said flexible blade has a width of between 10 and 60 millimeters, a thickness of between 1 and 5 millimeters and a length of between 10 and 1200 millimeters.
18. A device according to claim 1, wherein:
said surface of a friction layer has a high coefficient of friction with respect to a surface of said flexible blade.
19. An apparatus comprising:
a ski;
a device for dampening vibration of said ski, said device comprising:
at least one longitudinally extending flexible blade having a first portion and a second portion;
at least one fixed connection device for affixing the first portion to the flexible blade against longitudinal movement with respect to the ski; and
at least one dampening connection device to be affixed to the ski for allowing the second portion of said flexible blade to move longitudinally with respect to the ski upon ski flexion, said at least one dampening connection device comprising a frictional connection, whereby said second portion of said flexible blade comprises a surface in a longitudinal frictional sliding relationship, with respect to a surface of said dampening connection device affixed with respect to the ski, during use of the ski, at least one of said surfaces comprising a surface of a friction layer having a high coefficient of friction;
said surface of a friction layer having a high coefficient of friction with respect to a surface of said flexible blade; and
said frictional connection further comprising a means for adjusting a friction force between said friction layer and said surface of said dampening connection with which said friction layer is in said frictional sliding relationship.
20. An apparatus according to claim 19, wherein:
said flexible blade is positioned and attached to an upper surface of said ski.
21. An apparatus according to claim 19, wherein:
said flexible blade is located within said ski.
22. An apparatus according to claim 19, wherein:
said ski comprises a front contact line and a central binding assembly zone; and
said flexible blade is positioned between said front contact line and said central binding assembly zone.
23. An apparatus according to claim 19, wherein:
said ski comprises a rear contact line and a central binding assembly zone; and
said flexible-blade is positioned between said rear contact line and said central binding assembly zone.
24. An apparatus according to claim 19, wherein:
said ski comprises a front contact line and a central binding assembly zone; and
said flexible blade extends both along said central binding assembly zone and along an area between said front Contact line and said central binding assembly zone.
25. An apparatus according to claim 19, wherein:
said ski comprises a rear contact line and a central binding assembly zone; and
said flexible blade extends both along said central binding assembly zone and along an area between said rear contact line and said central binding assembly zone.
26. An apparatus according to claim 22, wherein:
said first portion of said flexible blade comprises a rear end of said flexible blade; and
said second portion of said flexible blade comprises a front end of said flexible blade;
whereby said rear end of said flexible blade is affixed against longitudinal movement with respect to said ski and said front end of said flexible blade is affixed to said ski by means of said frictional connection.
27. An apparatus according to claim 22, wherein:
said first portion of said flexible blade comprises a front end of said flexible blade; and
said second portion of said flexible blade comprises a rear end of said flexible blade;
whereby said front end of said flexible blade is affixed against longitudinal movement with respect to said ski and said rear end of said flexible blade is affixed to said ski by means of said frictional connection.
28. An apparatus according to claim 19, wherein:

said ski comprises an elongated beam having a predetermined thickness distribution longitudinally along said beam and a predetermined width distribution longitudinally along said beam, thereby providing said beam with a predetermined stiffness suitable for use as a ski independently of said device for dampening vibration.

29. A device for dampening vibration of a ski, comprising:

at least one longitudinally extending flexible blade having a first portion and a second portion;

at least one fixed connection device for affixing the first portion to the flexible blade against longitudinal movement with respect to the ski; and at least one dampening connection device to be affixed to the ski for allowing the second portion of said flexible blade to move longitudinally with respect to the ski upon ski flexion, said at least one dampening connection device comprising a frictional connection, whereby said second portion of said flexible blade comprises a surface in a longitudinal frictional sliding relationship, with respect to a surface of said dampening connection device affixed with respect to the ski, during use of the ski, at least one of said surfaces comprising a surface of a friction layer having a high coefficient of friction;

said surface of a friction layer having a high coefficient of friction with respect to a surface of said flexible blade; and said frictional connection further comprising means for adjusting a friction force between said friction layer and said surface of said dampening connection with which said friction layer is in said frictional sliding relationship.

30. A device for dampening vibration of a ski, comprising:

at least one longitudinally extending flexible blade having a first portion and a second portion;

at least one fixed connection device for affixing the first portion to the flexible blade against longitudinal movement with respect to the ski; and at least one dampening connection device, a portion of said device to be affixed to the ski for allowing the second portion of said flexible blade to move longitudinally with respect to the ski upon ski flexion, said at least one dampening connection device comprising a frictional connection, said frictional connection comprising:

a first surface comprised by a surface fixed with respect to said second portion of said flexible blade;

a second surface comprised by a surface fixed with respect to the ski, during use of said ski;

wherein at least one of said first surface and said second surface is comprised by a layer of elastic material, said layer of elastic material being fixed with respect to, respectively, one of:

said second portion of said flexible blade; and said ski, during use of said ski; and said frictional connection further comprising a pressure element, said pressure element being adapted to be affixed to the ski for applying a force to maintain a frictional force between a surface of said flexible blade and a surface of said dampening connection device.

31. A device according to claim 30, wherein:

said layer of elastic material comprises a layer of visco-elastic material.

32. A device according to claim 30, wherein:

said layer of elastic material is affixed to said second portion of said flexible blade.

33. A device according to claim 30, wherein:

said layer of elastic material is adapted to be affixed to said ski, during use of said ski.

34. A device according to claim 30, wherein:

said layer of elastic material is affixed to said pressure element.

35. A device according to claim 30, wherein:

said pressure element comprises a stirrup affixed to said ski.

36. A device according to claim 30, further comprising:

a base plate of a ski binding that affixes a ski boot upon a ski, wherein said base plate comprises said pressure element.

37. A device according to claim 30, further comprising:

a support element for supporting a ski boot and means for mounting said support element for movement under the weight of the ski boot, wherein said support element comprises said pressure element.

* * * * *